US005996520A

United States Patent [19]

Arpiainen et al.

[11] Patent Number: 5,996,520

[45] Date of Patent: Dec. 7, 1999

[54] ICEBREAKING METHOD AND ICEBREAKER

[75] Inventors: Matti Arpiainen, Helsinki; Magnus Bäckström, Helsingfors; Torsten Heideman, Grankulla; Tom Mattson, Helsingfors; Erkki Ranki, Helsinki, all of Finland

[73] Assignee: Kvaerner Masa-Yards Oy, Helsinki, Finland

[21] Appl. No.: 09/031,141

[22] Filed: Feb. 26, 1998

[30] Foreign Application Priority Data

Feb. 27, 1997 [FI] Finland ..... 970820

[51] Int. Cl.[6] ..... B63B 35/08

[52] U.S. Cl. ..... 114/40; 114/41

[58] Field of Search ..... 114/40–42

[56] References Cited

U.S. PATENT DOCUMENTS 4,170,187 10/1979 Schirtzinger ..... 144/42
4,350,114 9/1982 Schirtzinger ..... 144/42
5,038,695 8/1991 Varges .
5,218,917 6/1993 Harjula et al .
5,403,216 4/1995 Salmi et al. .

FOREIGN PATENT DOCUMENTS 85967 3/1992 Finland .
97/20730 6/1997 WIPO .

*Primary Examiner*—Sherman Basinger
*Attorney, Agent, or Firm*—Smith-Hill and Bedell

[57] ABSTRACT

A relatively wide vessel is assisted through an ice field by an icebreaker having a relatively narrow hull. The icebreaker includes two steerable propulsion mechanisms at the opposite ends respectively of the hull, and the propulsion mechanisms are used to propel the icebreaker through the ice field in a direction at a substantial angle to its keel line, thereby opening in one pass of the icebreaker a passage having a width substantially greater than the waterline width of the icebreaker.

19 Claims, 3 Drawing Sheets

ICEBREAKING METHOD AND ICEBREAKER

BACKGROUND OF THE INVENTION

This invention relates to an icebreaking method for opening a passage through an ice field and to an icebreaker for carrying out the method.

An icebreaker is designed to assist vessels in winter traffic. Such assistance includes opening or maintaining passages through ice fields. Therefore an icebreaker usually is designed to be suitable for a particular winter traffic pattern. For example for the Gulf of Finland it is typical that the number of vessels requiring assistance is large and the distance over which assistance is required is relatively small. The size of the vessels to be assisted varies greatly which sets special requirements on the width of the channel the icebreaker makes. The width of a vessel to be assisted in the Gulf of Finland is typically in the range from 10 to 40 m.

A conventional icebreaker cannot effectively assist a vessel the width of which exceeds the width of the icebreaker. On the other hand it is relatively seldom that very wide vessels need to be assisted so it would not be economic to build for example a 40 m wide icebreaker only for the few occasions on which such a wide icebreaker is needed. Hitherto it has been conventional to assist a wide vessel either by using one icebreaker to open a wide passage by going back and forth or by using two icebreakers at the same time together to open a wide passage. The first mentioned method is slow and rather ineffective, especially if the ice field is moving. The second method requires two icebreakers, which impairs the ability of the icebreaker fleet to render assistance elsewhere.

According to U.S. Pat. No. 5,218,917, the direction of movement of an icebreaker in heavy ice conditions may be different from its direction of movement in open sea and light ice.

SUMMARY OF THE INVENTION

The object of the invention is to solve the problem of how to effectively and economically assist a very wide vessel in an ice field using only one icebreaker. The icebreaker for carrying out the method according to the invention may be driven wholly or partly sideways through the ice field. By orienting the keel line of the icebreaker at a suitable angle to the travel direction of the icebreaker, it becomes possible to use the icebreaker to open a channel of which the width may be substantially greater than the waterline width of the icebreaker and in an extreme case even as great as the waterline length of the icebreaker.

The term "direction of the keel line" as used in this specification means the direction of movement of the icebreaker that is chosen when the icebreaker moves in open water or ice so that a minimum resistance to movement is achieved.

Each end of the hull of an icebreaker according to the invention is provided with at least one steerable propulsion mechanism. The term "steerable propulsion mechanism" means a propulsion mechanism, the direction of propulsion of which may be freely chosen. The most common and for icebreakers most suitable propulsion mechanism having this characteristic is a so-called rudder propulsion device, that is a propulsion device which is turnable around a substantially vertical axis so that the direction of propulsion may be changed by turning the propulsion device. A device like this has been described e.g. in U.S. Pat. No. 5,403,216.

A sufficient efficiency is not always achieved with a single steerable propulsion mechanism at each end of the hull. Therefore it is preferable that the icebreaker is provided with at least three steerable propulsion mechanisms, of which two are at the end of the icebreaker that is in front in the direction of travel in heavy ice conditions. In order to ensure a desired steering of the icebreaker according to the invention it is especially important that the distribution of power between the different propulsion mechanisms can be varied, preferably steplessly, according to the situation. Thereby the power of the driving machinery of the icebreaker may always be distributed suitably among the separate propulsion devices according to need so that by controlling the power distribution the direction of travel and the angular displacement between the direction of the keel line and the direction of travel may be influenced. In an icebreaker with a total propulsion power P and a number of propulsion mechanisms n, the use of the propulsion mechanisms is preferably optimized so that each propulsion mechanism is dimensioned so that it can, if necessary, receive and operate at a propulsion power level substantially greater than P/n, preferably about 1.5 P/n, while the other propulsion mechanisms receive and operate at a power level lower than P/n.

It is preferable that if a steerable propulsion mechanism has a screw propeller as its propulsion element, the propulsion mechanism is so designed that the propeller functions as a pulling propeller, i.e. the propeller is in the front end of the propulsion mechanism in the travel direction of the icebreaker. In this case, the propeller is able to break up ice wall formations and other ice obstacles at the draught of the propeller.

According to a preferred embodiment of the invention the hull of the icebreaker is symmetric and is so designed that in the icebreaking area, that is between a level close to the waterline and a level at about half the draught of the icebreaker, each side has an outwards/upwards slope, whereby both sides of the icebreaker are suitable for icebreaking in a sideways direction.

In the case of a symmetric hull with advantageous breaking angles at each side for icebreaking action by oblique or sideways movement of the icebreaker, the icebreaker may have to be rather large in order for the underwater portion of the hull to provide sufficient buoyancy.

According to another preferred embodiment of the invention, the hull of the icebreaker is asymmetric and is so designed that one side of the hull is more advantageous for icebreaking than its opposite side. This allows the one side of the hull to have advantageous breaking angles for icebreaking action by oblique or sideways movement of the icebreaker while the other side of the hull can be configured to provide sufficient buoyancy to compensate for the reduced buoyancy of the icebreaking side.

It is also advantageous to design the hull of the icebreaker so that the steerable propulsion mechanisms may be placed at both ends of the hull at such a height that they at least do not substantially extend below the lowest part of the hull. Thereby, e.g., docking of the icebreaker is substantially facilitated and the danger of very serious damage in case of running aground is reduced.

The invention also relates to an icebreaker which is suitable for opening a passage for a wide vessel through an ice field, whereby the waterline width of the hull of the icebreaker is substantially smaller than the waterline width of the wide vessel.

BRIEF DESCRIPTION OF THE DRAWINGS

The invention is described in the following by way of example referring to the attached schematic drawings, where.

DETAILED DESCRIPTION

Figure 1:
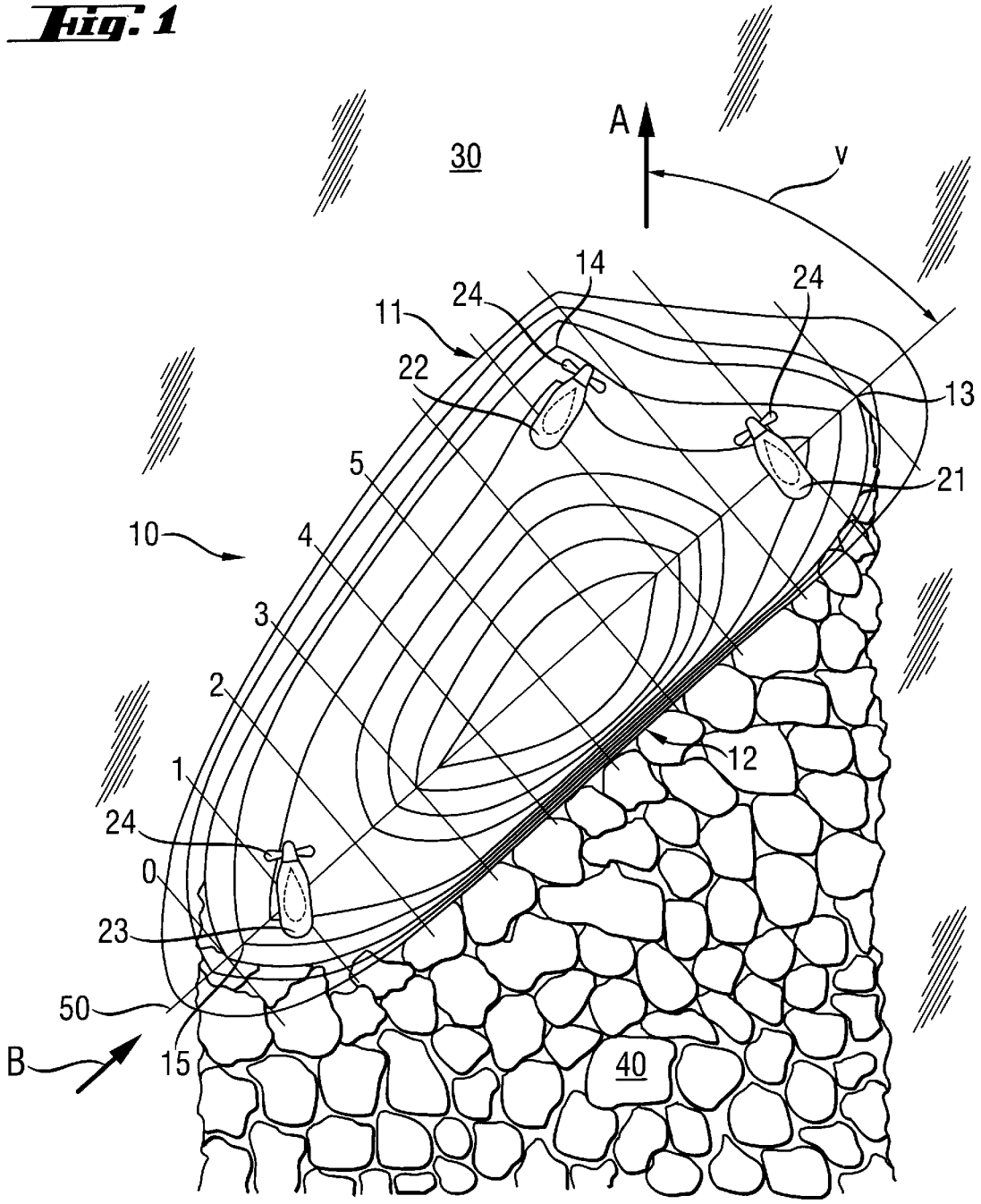
FIG. 1 shows a fish's eye view of an icebreaker being used to carry out the method according to the invention.

FIG. 1 shows a solid ice field 30 through which an icebreaker 10 is opening a passage or channel 40 for a wide vessel (not shown) following behind the icebreaker by moving in the direction of an arrow A. The waterline width of the icebreaker 10 is substantially smaller than the waterline width of the vessel that is to be assisted. One end of the hull of the icebreaker is provided with two steerable propulsion mechanisms 21, 22, and the opposite end of the hull is provided with one steerable propulsion mechanism 23. The end provided with the propulsion mechanism 23 would be considered the bow for the purpose of navigating in open water and the keel line 50 would be aligned with the direction of movement, but for icebreaking, the directions of propulsion of the respective propulsion mechanisms are chosen so that the icebreaker moves sideways in the direction of the arrow A through the ice field 30, that is the direction of movement indicated by the arrow A is at a substantial angle v to the direction of the keel line 50.

In the embodiment according to FIG. 1 the hull of the icebreaker 10 is asymmetric so that its one side, which is turned towards the direction A of travel of the icebreaker, is more advantageous for breaking ice sideways than its other side 12. The design of the lower part of the hull appears from the design curves of the horizontal sections shown in FIG. 1. The end of the asymmetric icebreaker which is forward in the direction of travel is wider than its opposite end.

Figure 2:
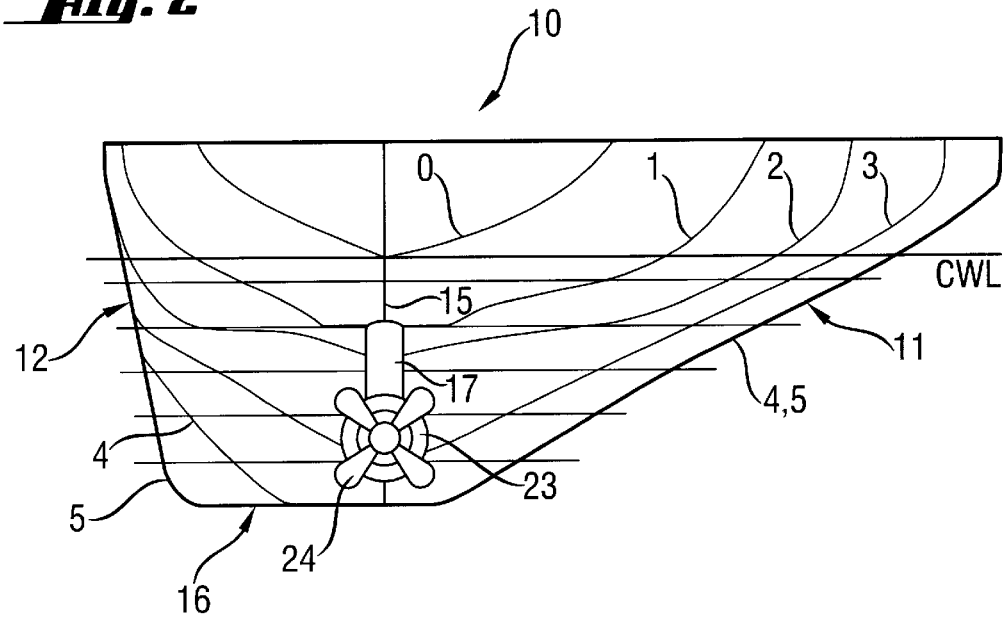
FIG. 2 shows an end view of an asymmetric icebreaker according to the invention.

In FIG. 2 the asymmetric icebreaker is shown viewed in the direction of arrow B in FIG. 1. The view shown in FIG. 2 is typical of an asymmetric icebreaker according to the invention and is not restricted to the icebreaker shown in FIG. 1. As may be seen from FIG. 2 the side of the icebreaker used for breaking ice, at the level of the construction waterline and downward, has a substantial degree of outwards/upwards slope, which is favorable for breaking ice. The opposite side 12 is almost vertical. The design of the hull also appears from the design curves of the vertical section planes 0, 1, 2, 3, 4 and 5.

According to FIG. 1 the wider end, which would be considered the stern for the purpose of navigating in open water but is forward in the direction of travel of the icebreaker in the ice field, is provided with two propulsion mechanisms 21 and 22 and the opposite end is provided with a single propulsion mechanism 23. Such an arrangement is advantageous for example in achieving a sufficient icebreaking effectiveness in heavy ice conditions. Furthermore, the propeller stream of the propulsion mechanism 22, which is spaced laterally from the keel line away from the vertical side 12 of the hull, may advantageously be used for washing the icebreaking side 11, which lessens the friction between the hull and the ice. At the same time the propeller stream pushes broken ice backwards along the hull. This takes place in a most efficient manner by directing the propulsion mechanism 22 in the way shown in FIG. 1. The lower portion of the hull is preferably designed in the way shown in FIGS. 1 and 2 so that the propeller stream of the propulsion mechanism 22 promotes breaking by creating turbulence under unbroken ice and drawing water from under unbroken ice.

Each propulsion mechanism 21, 22, 23 is turnable in a desired direction and is provided with a screw propeller 24 functioning as a propulsion element. The structure and placement of each propeller 24 is such that it normally functions as a pulling propeller, i.e. the propeller 24 is at the forward end of the propulsion mechanism in the direction of travel of the icebreaker. In this way the propellers may advantageously be used for example for breaking an ice wall formation. In FIG. 1 the propulsion mechanisms 21 and 22 are turned so that their combined propulsion force is more or less in the direction of arrow A.

As described above, the icebreaker is designed and constructed for breaking ice when moving in a direction at a substantial angle to the direction of the keel line. Depending on the circumstances, the icebreaker may also be used for breaking ice when moving in the direction of the keel line, either with the propulsion mechanisms 21 and 22 ahead or with the propulsion mechanism 23 ahead.

If the turnable shaft 17 of a propulsion mechanism strikes a big ice block as the icebreaker is moving through an ice field, it may result in an increase in the resistance to movement through the ice field. In order to crack these iceblocks before they are struck by the turnable shafts 17, the hull of the icebreaker is formed with ridges 13, 14, 15 which extend at least from the level of the construction waterline CWL of the hull of the icebreaker to the immediate vicinity of the propulsion mechanisms 21, 22, 23 respectively.

Figure 3:
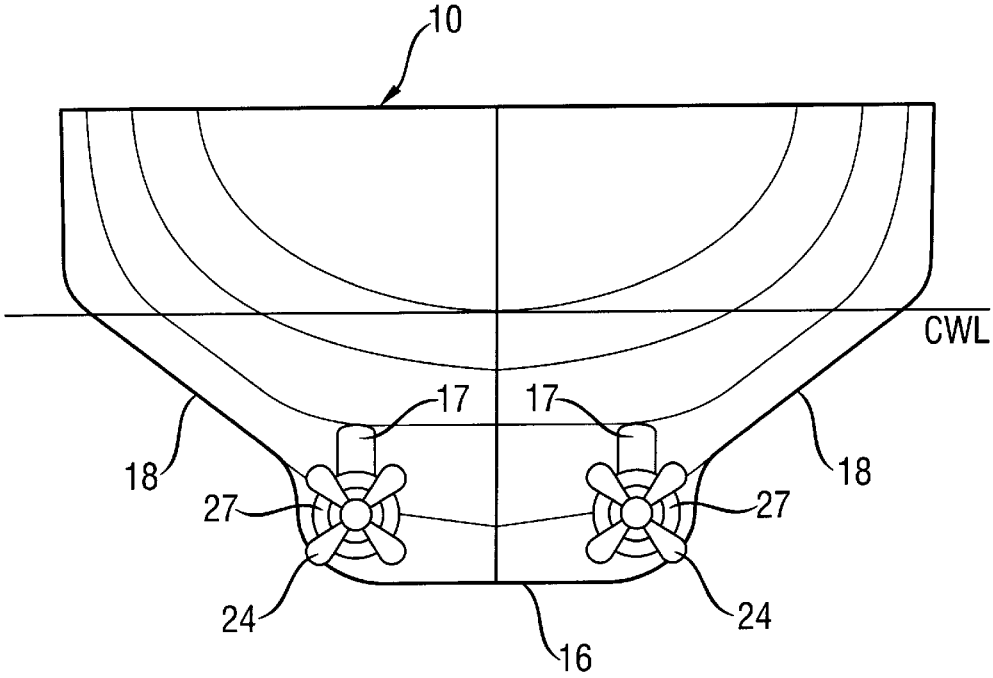
FIG. 3 shows an end view of a symmetric icebreaker according to the invention.
Figure 4:
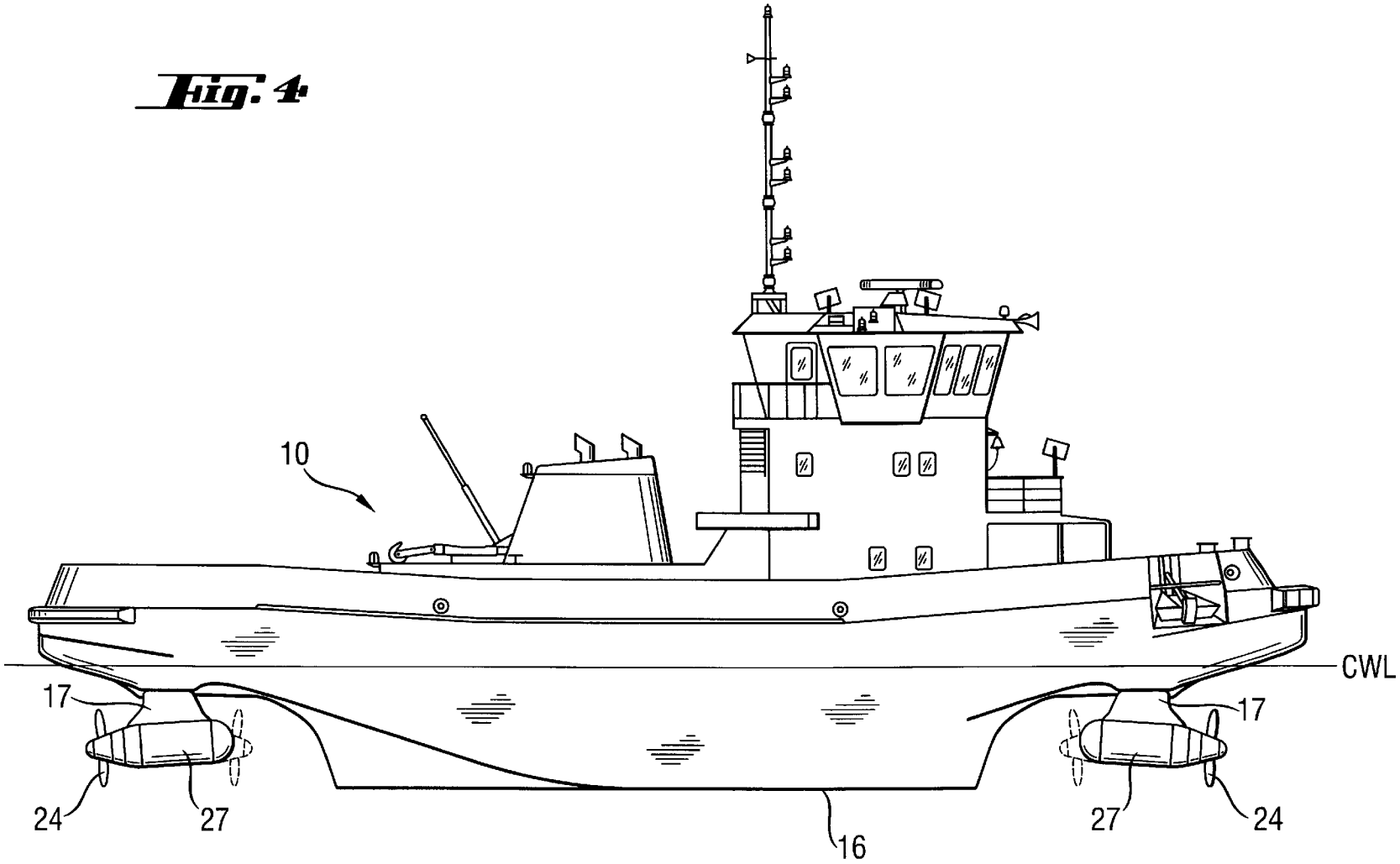
FIG. 4 shows a side view of a symmetric icebreaker according to the invention.

As may be seen in FIGS. 2, 3 and 4 the propulsion mechanisms and their propellers 24 are above the lowest point 16 of the hull of the icebreaker.

In FIG. 3 the hull of the icebreaker is symmetrical and the two sides 18 have an outwards/upwards slope at the level of the construction waterline CWL of the icebreaker and from there downward, whereby both sides are suitable for breaking ice when the icebreaker moves sideways through an ice field. The icebreaker is preferably provided with an efficient heeling system known per se which together with the design of the sides and hull loosens up compressed or packed ice or ice blocks, ensuring that the icebreaker can maintain forward movement and will not get stuck, even in difficult ice conditions. In the symmetrical embodiment according to FIG. 3 the icebreaker at least at one end has two steerable propulsion mechanisms 27. The structure, arrangement and function of the propulsion mechanisms corresponds substantially to what has been described above referring to FIG. 1.

FIG. 4 shows a side view of a rather small icebreaker according to the invention. Each end of the hull of the icebreaker is provided with two steerable propulsion mechanisms 27. The principle dimensions of the icebreaker are: maximum length about 32 m, waterline length about 29 m and maximum width about 12.5 m. In practice the principal dimensions of an icebreaker operating in difficult ice conditions in the Baltic Sea would preferably be about twice those of the icebreaker shown in FIG. 4. Such an icebreaker is able to open a passage 40 m wide in a single pass by traveling at an acute angle to its keel line.

It will be appreciated that the invention is not restricted to the particular embodiment that has been described, and that variations may be made therein without departing from the scope of the invention as defined in the appended claims and equivalents thereof. For example, although the icebreaker according to the invention has mainly been described with reference to opening a passage in an ice field, it may naturally be used also for maintaining an existing passage or enlarging a passage of insufficient width.

We claim:

1. A method of assisting a relatively wide vessel through an ice field, said method comprising:

providing an icebreaker having a relatively narrow hull with a keel line and first and second opposite ends, the icebreaker including at least first and second steerable propulsion mechanisms at the first and second ends respectively of the hull, and employing the propulsion mechanisms to propel the icebreaker through the ice field in a direction at a substantial angle to the keel line, thereby opening in one pass of the icebreaker a passage having a width substantially greater than the waterline width of the icebreaker.

2. A method according to claim 1, wherein the icebreaker includes two steerable propulsion mechanisms at the first end of the hull.

3. A method according to claim 1, wherein the icebreaker includes two steerable propulsion mechanisms at each end of the hull.

4. A method according to claim 1, wherein each steerable propulsion mechanism includes a screw propeller operating as a pulling propeller in the direction of movement of the icebreaker.

5. A method according to claim 1, wherein the hull of the icebreaker has first and second sides, at opposite sides respectively of the keel line, and each side of the hull slopes upward and outward.

6. A method according to claim 1, wherein the hull of the icebreaker has first and second sides, at opposite sides respectively of the keel line, and the hull is asymmetric so that the first side is more advantageous for icebreaking than the second side, and the method comprises employing the propulsion mechanisms to propel the icebreaker through the ice field with the first side of the hull ahead of the second side.

7. A method according to claim 1, wherein the steerable propulsion mechanisms are at least substantially completely above the lowest point of the hull of the icebreaker.

8. An icebreaker for assisting relatively wide vessels through ice fields, the icebreaker having a relatively narrow hull with a keel line and first and second opposite ends and including first and second steerable propulsion mechanisms at the first and second ends respectively of the hull, and wherein the directions of propulsion of the propulsion mechanisms are controllable so that they can propel the icebreaker through an ice field in a direction at a substantial angle to the keel line, whereby the icebreaker can be employed to open, in one pass, a passage having a width substantially greater than the waterline width of the icebreaker.

9. An icebreaker according to claim 8, including driving machinery providing a maximum propulsion power P and wherein the number of steerable propulsion mechanisms is n and each propulsion mechanism is dimensioned to receive and operate at a maximum propulsion power substantially greater than P/n.

10. An icebreaker according to claim 9, wherein each propulsion mechanism is dimensioned to receive and operate at a maximum propulsion power of about 1.5 P/n.

11. An icebreaker according to claim 8, including a third steerable propulsion mechanism at the first end of the hull.

12. An icebreaker according to claim 11, wherein the third steerable propulsion mechanism is spaced from the keel line of the hull and the hull includes a ridge which extends from the waterline of the hull toward the third steerable propulsion mechanism.

13. An icebreaker according to claim 8, including third and fourth steerable propulsion mechanisms at the first and second ends respectively of the hull.

14. An icebreaker according to claim 8, wherein each steerable propulsion mechanism includes a screw propeller constructed and arranged so that it functions as a pulling propeller.

15. An icebreaker according to claim 8, wherein the steerable propulsion mechanisms are at least substantially completely above the lowest point of the hull of the icebreaker.

16. An icebreaker according to claim 8, wherein the hull of the icebreaker has first and second sides, at opposite sides respectively of the keel line, and each side of the hull slopes upward and outward.

17. An icebreaker according to claim 8, wherein the hull of the icebreaker has first and second sides, at opposite sides respectively of the keel line, and the hull is asymmetric so that the first side is more advantageous for icebreaking than the second side when the icebreaker is propelled in a direction at a substantial angle to the keel line.

18. An icebreaker according to claim 8, wherein the hull includes a ridge which extends from the waterline of the hull toward the first steerable propulsion mechanism.

19. An icebreaker according to claim 8, wherein the hull includes first and second ridges which extend from the waterline of the hull toward the first and second steerable propulsion mechanisms respectively.

* * * * *